US009353933B2

(12) United States Patent
Van De Ven

(10) Patent No.: US 9,353,933 B2
(45) Date of Patent: May 31, 2016

(54) LIGHTING DEVICE WITH POSITION-RETAINING ELEMENT

(75) Inventor: Antony Paul Van De Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 626 days.

(21) Appl. No.: 12/566,936

(22) Filed: Sep. 25, 2009

(65) Prior Publication Data

US 2011/0075423 A1 Mar. 31, 2011

(51) Int. Cl.

| | |
|---|---|
| ***F21S 8/00*** | (2006.01) |
| ***F21V 21/04*** | (2006.01) |
| ***F21V 17/16*** | (2006.01) |
| ***F21V 17/02*** | (2006.01) |
| ***F21V 19/02*** | (2006.01) |
| ***F21V 21/14*** | (2006.01) |
| *F21Y 101/02* | (2006.01) |
| *F21S 8/02* | (2006.01) |

(52) U.S. Cl.

CPC ..... *F21V 21/04* (2013.01); *F21V 17/02* (2013.01); *F21V 17/162* (2013.01); *F21V 19/02* (2013.01); *F21V 21/14* (2013.01); *F21S 8/026* (2013.01); *F21Y 2101/02* (2013.01)

(58) Field of Classification Search

CPC ..... A01B 12/006; F21V 21/04; F21V 17/02; F21V 19/02; F21V 21/14; F21V 17/06; F21V 17/08; F21V 17/104; F21V 17/162; F21V 21/22; F21V 21/34; F21Y 2101/02; F21S 8/026

USPC ..... 362/269, 270, 271, 372, 370, 371, 285, 362/431, 145, 147, 649, 650, 249.02, 362/249.03, 148, 364, 418, 435, 288

See application file for complete search history.

(56) References Cited

U.S. PATENT DOCUMENTS

| | | | | |
|---|---|---|---|---|
| 1,849,966 A | * | 3/1932 | Ureles | 248/343 |
| 1,880,952 A | * | 10/1932 | Fabrey | 362/429 |
| 1,972,056 A | * | 8/1934 | Saaf | 362/429 |
| 3,755,697 A | | 8/1973 | Miller | |
| 3,787,752 A | | 1/1974 | Delay | |

(Continued)

FOREIGN PATENT DOCUMENTS

WO WO 2005/015080 * 2/2005 ..... F21V 17/08

OTHER PUBLICATIONS

U.S. Appl. No. 12/411,905, filed Mar. 26, 2009, Van de Ven.

(Continued)

*Primary Examiner* — Peggy Neils

(74) *Attorney, Agent, or Firm* — Burr & Brown, PLLC

(57) ABSTRACT

A lighting device comprising a first element that comprises an electrical connector, a second element that comprises at least a first light source, and a position-retaining element (or means) that holds the second element in any of at least two positions relative to the first element. Also, a lighting device comprising a first element that comprises an electrical connector, a second element that comprises at least a first trim element, and a position-retaining element (or means) that holds the second element in any of at least two positions relative to the first element. The electrical connector is electrically connected to at least a first light source, and the second element is movable relative to the first element among the positions while maintaining electrical connection between the electrical connector and at least the first light source.

46 Claims, 11 Drawing Sheets

(56) References Cited

U.S. PATENT DOCUMENTS

| | | | | | |
|---|---|---|---|---|---|
| 4,090,189 | A | | 5/1978 | Fisler | |
| 4,232,361 | A | * | 11/1980 | Kelsall | 362/364 |
| 4,327,402 | A | * | 4/1982 | Aubrey | 362/288 |
| 4,459,648 | A | * | 7/1984 | Ullman | 362/307 |
| 4,717,868 | A | | 1/1988 | Peterson | |
| 4,918,487 | A | | 4/1990 | Coulter, Jr. | |
| 5,151,679 | A | | 9/1992 | Dimmick | |
| 5,175,528 | A | | 12/1992 | Choi et al. | |
| 5,345,167 | A | | 9/1994 | Hasegawa et al. | |
| 5,575,459 | A | * | 11/1996 | Anderson | 362/240 |
| 5,631,190 | A | | 5/1997 | Negley | |
| 5,661,645 | A | | 8/1997 | Hochstein | |
| 5,736,881 | A | | 4/1998 | Ortiz | |
| 5,758,959 | A | * | 6/1998 | Sieczkowski | 362/365 |
| 5,844,377 | A | | 12/1998 | Anderson et al. | |
| 5,912,477 | A | | 6/1999 | Negley | |
| 5,912,568 | A | | 6/1999 | Kiley | |
| 6,150,771 | A | | 11/2000 | Perry | |
| 6,161,910 | A | | 12/2000 | Reisenauer et al. | |
| 6,220,722 | B1 | * | 4/2001 | Begemann | 362/231 |
| 6,222,172 | B1 | | 4/2001 | Fossum et al. | |
| 6,285,139 | B1 | | 9/2001 | Ghanem | |
| 6,329,760 | B1 | | 12/2001 | Bebenroth | |
| 6,340,868 | B1 | | 1/2002 | Lys et al. | |
| 6,362,578 | B1 | | 3/2002 | Swanson et al. | |
| 6,388,393 | B1 | | 5/2002 | Illingworth | |
| 6,400,101 | B1 | | 6/2002 | Biebl et al. | |
| 6,528,954 | B1 | | 3/2003 | Lys et al. | |
| 6,577,072 | B2 | | 6/2003 | Saito et al. | |
| 6,586,890 | B2 | | 7/2003 | Min et al. | |
| 6,614,358 | B1 | | 9/2003 | Hutchison et al. | |
| 6,636,003 | B2 | | 10/2003 | Rahm et al. | |
| 6,724,376 | B2 | | 4/2004 | Sakura et al. | |
| 6,747,420 | B2 | | 6/2004 | Barth et al. | |
| 6,808,287 | B2 | | 10/2004 | Lebens et al. | |
| 6,836,081 | B2 | | 12/2004 | Swanson et al. | |
| 6,841,947 | B2 | | 1/2005 | Berg-johansen | |
| 6,873,203 | B1 | | 3/2005 | Latham, II et al. | |
| 6,918,216 | B2 | * | 7/2005 | Hoy et al. | 52/200 |
| 6,987,787 | B1 | | 1/2006 | Mick | |
| 6,995,518 | B2 | | 2/2006 | Havlik et al. | |
| 7,038,399 | B2 | | 5/2006 | Lys et al. | |
| 7,071,762 | B2 | | 7/2006 | Xu et al. | |
| 7,097,330 | B1 | * | 8/2006 | Straus et al. | 362/368 |
| 7,119,498 | B2 | | 10/2006 | Baldwin et al. | |
| 7,180,487 | B2 | | 2/2007 | Kamikawa et al. | |
| 7,202,608 | B2 | | 4/2007 | Robinson et al. | |
| 7,213,940 | B1 | | 5/2007 | Van De Ven et al. | |
| 7,247,049 | B2 | * | 7/2007 | Ratican | 439/537 |
| 7,309,137 | B2 | * | 12/2007 | Chan | 362/184 |
| 7,311,425 | B2 | * | 12/2007 | Jervey, III | 362/407 |
| 7,476,006 | B2 | * | 1/2009 | Hinds | 362/286 |
| 7,530,717 | B2 | * | 5/2009 | Magisano et al. | 362/365 |
| 7,722,227 | B2 | * | 5/2010 | Zhang et al. | 362/364 |
| 7,771,085 | B2 | * | 8/2010 | Kim | 362/285 |
| 7,772,227 | B2 | * | 8/2010 | Adam-Worrall | 514/224.5 |
| 8,297,804 | B2 | * | 10/2012 | Buse | 362/364 |
| 8,334,640 | B2 | * | 12/2012 | Reed et al. | 313/35 |
| 2006/0013009 | A1 | * | 1/2006 | Falco, Jr. | 362/418 |
| 2007/0139923 | A1 | | 6/2007 | Negley | |
| 2007/0170447 | A1 | | 7/2007 | Negley | |
| 2007/0171145 | A1 | | 7/2007 | Coleman | |
| 2007/0236911 | A1 | | 10/2007 | Negley | |
| 2007/0263393 | A1 | | 11/2007 | Van de Ven | |
| 2007/0274063 | A1 | | 11/2007 | Negley | |
| 2007/0274080 | A1 | | 11/2007 | Negley | |
| 2007/0278934 | A1 | | 12/2007 | Van de Ven | |
| 2007/0278974 | A1 | | 12/2007 | Van de Ven | |
| 2007/0279440 | A1 | | 12/2007 | Negley | |
| 2007/0279903 | A1 | | 12/2007 | Negley | |
| 2007/0280624 | A1 | | 12/2007 | Negley | |
| 2008/0084685 | A1 | | 4/2008 | Van de Ven | |
| 2008/0084700 | A1 | | 4/2008 | Van de Ven | |
| 2008/0084701 | A1 | | 4/2008 | Van de Ven | |
| 2008/0088248 | A1 | | 4/2008 | Myers | |
| 2008/0089053 | A1 | | 4/2008 | Negley | |
| 2008/0106895 | A1 | | 5/2008 | Van de Ven | |
| 2008/0106907 | A1 | | 5/2008 | Trott | |
| 2008/0112168 | A1 | | 5/2008 | Pickard | |
| 2008/0112170 | A1 | | 5/2008 | Trott | |
| 2008/0112183 | A1 | | 5/2008 | Negley | |
| 2008/0130285 | A1 | | 6/2008 | Negley | |
| 2008/0137347 | A1 | | 6/2008 | Trott | |
| 2008/0278950 | A1 | | 11/2008 | Pickard | |
| 2008/0278952 | A1 | | 11/2008 | Trott | |
| 2008/0278957 | A1 | | 11/2008 | Pickard | |
| 2008/0304261 | A1 | | 12/2008 | Van de Ven | |
| 2008/0304269 | A1 | | 12/2008 | Pickard | |
| 2008/0309255 | A1 | | 12/2008 | Myers | |
| 2009/0108269 | A1 | | 4/2009 | Negley | |
| 2009/0160363 | A1 | | 6/2009 | Negley | |
| 2009/0161356 | A1 | | 6/2009 | Negley | |
| 2009/0184662 | A1 | | 7/2009 | Given | |
| 2009/0184666 | A1 | | 7/2009 | Myers | |
| 2009/0296384 | A1 | | 12/2009 | Van de Ven | |
| 2010/0027258 | A1 | | 2/2010 | Maxik et al. | |
| 2010/0102199 | A1 | | 4/2010 | Negley | |
| 2010/0102697 | A1 | | 4/2010 | Van de Ven | |
| 2010/0103678 | A1 | | 4/2010 | Van de Ven | |

OTHER PUBLICATIONS

U.S. Appl. No. 12/566,850, filed Sep. 25, 2009, Van de Ven.
U.S. Appl. No. 12/566,142, filed Sep. 24, 2009.
U.S. Appl. No. 12/566,195, filed Sep. 24, 2009.
U.S. Appl. No. 12/566,857, filed Sep. 25, 2009, Van de Ven.
U.S. Appl. No. 12/621,970, filed Nov. 19, 2009, Van de Ven.
"*HALO" LED Recessed Lighting in the 21st Century*, Cooper Lighting, www.cooperlighting.com.

* cited by examiner

LIGHTING DEVICE WITH POSITION-RETAINING ELEMENT

FIELD OF THE INVENTIVE SUBJECT MATTER

The present inventive subject matter relates to lighting devices. In some aspects, the present inventive subject matter relates to lighting devices that can readily be positioned relative to construction elements, e.g., ceilings, walls, floors, etc., and held in position relative to such construction elements.

BACKGROUND

There exist a wide variety of lighting devices and light fixtures that can be positioned relative to construction elements and that can be held in position relative to such construction elements. For example, there exist a variety of "can" light fixtures that can be mounted in a construction element, e.g., often a ceiling, which comprise a cylindrical outer structure, an Edison socket and a trim element. Many of such can light fixtures include one or more spring retainer clips (sometimes referred to as "chicken claws") which comprise at least first and second spring-loaded arms (attached to the trim element) and at least one engagement element (attached to the cylindrical outer structure), the first and second spring loaded arms being spring biased apart from each other into contact with opposite sides of the engagement element, creating friction which holds the trim element in position relative to the cylindrical outer structure, while permitting the trim element to be moved to different positions relative to the cylindrical outer structure.

There is an ongoing need, however, for lighting devices in which installation and/or retrofitting of the lighting devices is/are simplified, in which greater flexibility is obtainable (e.g., a lighting device can be installed in a greater variety of structures, e.g., fixture housings) and/or in which the trim elements (or analogous or similar elements) are more securely held in place.

BRIEF SUMMARY OF THE INVENTIVE SUBJECT MATTER

In accordance with another aspect of the present inventive subject matter, there is provided a lighting device that comprises a first element that comprises a first electrical connector, a second element that comprises at least a first light source, and a position-retaining element that holds the second element in position relative to the first element.

In accordance with another aspect of the present inventive subject matter, there is provided a lighting device that comprises a first element and a second element that are movable relative to each other.

In accordance with another aspect of the present inventive subject matter, there is provided a lighting device that comprises a first element that comprises an electrical connector (e.g., an Edison plug), a second element that comprises at least a first light source, and a position retaining element that holds the second element in any of at least two positions relative to the first element, and in which the second element can be moved between or among the positions.

In accordance with another aspect of the present inventive subject matter, there is provided a lighting device that comprises a first element that comprises an electrical connector (e.g., an Edison plug), a second element that comprises at least a first light source, and a position retaining element that holds the second element in any of at least two positions relative to the first element, the electrical connector being electrically connected to at least the first light source, the second element being movable relative to the first element among the positions while maintaining electrical connection between the electrical connector and at least the first light source.

In some embodiments according to the present inventive subject matter, the second element further comprises a mixing chamber element.

In some embodiments according to the present inventive subject matter, the second element further comprises a trim element.

In some embodiments according to the present inventive subject matter, the second element further comprises a mixing chamber element and a trim element.

In some embodiments according to the present inventive subject matter, the second element further comprises a combined mixing chamber element and trim element.

In accordance with another aspect, the present inventive subject matter relates to a method of installing a lighting device, the method comprising connecting a first electrical connector of a first element to a second electrical connector, and positioning a second element that comprises at least one light source relative to the first element by engaging a position-retaining element, that is attached to one of the first element and the second element, to the other of the first element and the second element. In some of such embodiments, the position-retaining element holds the second element in any of at least two positions relative to the first element. In some of such embodiments, the second element is movable relative to the first element among the positions.

The inventive subject matter may be more fully understood with reference to the accompanying drawings and the following detailed description of the inventive subject matter.

BRIEF DESCRIPTION OF THE DRAWING FIGURES

FIGS. 9-15 schematically depict a lighting device 100 in accordance with the present inventive subject matter.

Figure 16:
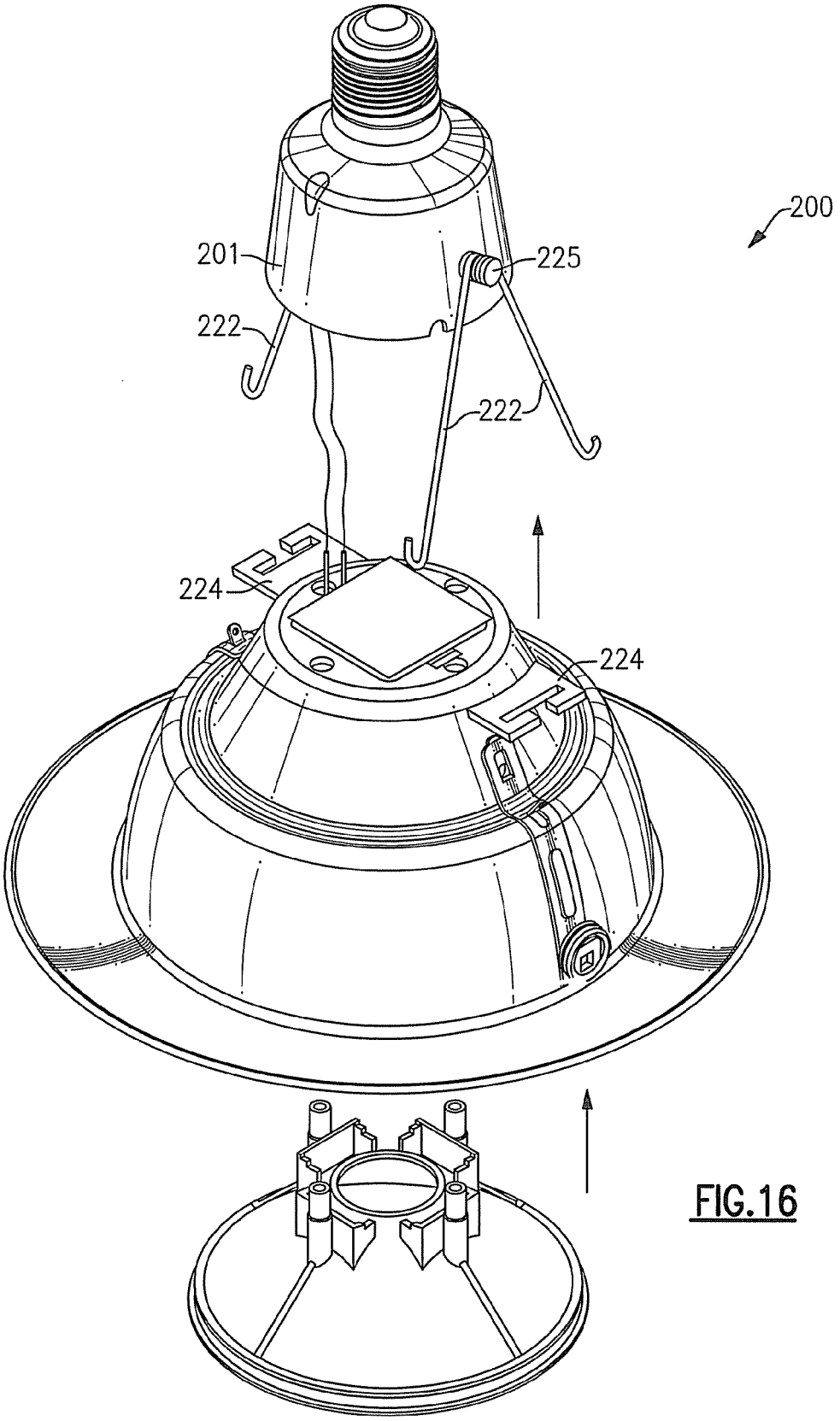

FIG. 16 schematically depicts an exploded view of a lighting device 200 in accordance with the present inventive subject matter.

DETAILED DESCRIPTION OF THE INVENTIVE SUBJECT MATTER

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a light source (e.g., a solid state light emitter), means that at least some current (or other stimulus) is being supplied to the light source to cause the light source to emit at least some electromagnetic radiation (e.g., visible light). The expression "illuminated" encompasses situations where the light source emits electromagnetic radiation continuously, or intermittently at a rate such that a human eye would perceive it as emitting electromagnetic radiation continuously or intermittently, or where a plurality of light sources that emit visible light of the same color or different colors are emitting light intermittently and/or alternatingly (with or without overlap in "on" times) in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "substantially cylindrical", as used herein, means that at least 95% of the points in the surface which is characterized as being substantially cylindrical are located on one of or between a pair of imaginary cylindrical structures which are spaced from each other by a distance of not more than 5% of their largest dimension.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least light source in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, some embodiments according to the present inventive subject matter relate to a lighting device comprising a first element that comprises an electrical connector, a second element that comprises at least a first light source, and a position retaining element that holds the second element in any of at least two positions relative to the first element.

Other embodiments according to the present inventive subject matter relate to a lighting device comprising a first element that comprises an electrical connector that is electrically connected to at least a first light source, a second element that comprises at least a first trim element, and a position retaining element that holds the second element in any of at least two positions relative to the first element.

Various types of electrical connectors are well known to those skilled in the art, and any of such electrical connectors can be used in the lighting devices according to the present inventive subject matter. Representative examples of suitable types of electrical connectors include Edison plugs (which are receivable in Edison sockets) and GU24 pins (which are receivable in GU24 sockets).

Persons of skill in the art are familiar with, and have ready access to, a wide variety of light sources (of white or any other color), and any suitable light source (or sources) can be employed in the lighting devices according to the present inventive subject matter.

Representative examples of types of light sources include solid state light emitters, incandescent lights, fluorescent lamps, laser diodes, thin film electroluminescent devices, light emitting polymers (LEPs), halogen lamps, high intensity discharge lamps, electron-stimulated luminescence lamps, etc., with or without filters. That is, the at least one light source can comprise a single light source, a plurality of light sources of a particular type, or any combination of one or more light sources of each of a plurality of types.

Each of the one or more light sources can be selected from among any or all of the wide variety of light sources known to persons of skill in the art. That is, the at least one light source can comprise a single light source, two or more light sources of a particular type, or any combination of one or more light sources of each of a plurality of types.

The various types of light sources have been provided in a variety of shapes, sizes and arrangements, e.g., A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc., and any of such shapes, sizes and arrangements (whether listed above or not) can be employed in the lighting devices according to the present inventive subject matter.

The various types of light sources have been designed so as to serve any of a variety of functions (e.g., as a flood light, as a spotlight, as a downlight, etc.), and have been used in residential, commercial or other applications, and light sources serving such functions (or any other suitable function) and/or for such applications (or for any other application) can be employed in the lighting devices according to the present inventive subject matter.

As noted above, one or more of the one or more light source(s) in a lighting device according to the present inventive subject matter can be a solid state light emitter. A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Lighting devices or lighting arrangements according to the present inventive subject matter can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

The one or more solid state light emitters (and optionally one or more luminescent materials) can be arranged in any suitable way.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley; the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

The electrical connector is electrically connected to at least the first light source in any suitable way. A representative example of a way to electrically connect a light source to the electrical connector is to connect a first portion of a flexible wire to the electrical connector and to connect a second portion of the flexible wire to a circuit board on which the first light source (or a plurality of light sources) is mounted.

The position-retaining element can be any suitable element that can hold the second element in two or more positions relative to the first element, and that allows the second element to be moved between or among such positions.

A representative example of a suitable position-retaining element is a spring-retaining clip (also known as a chicken claw), which comprises at least first and second spring-loaded arms and at least one engagement element, the first and second spring loaded arms being spring biased into contact with respective surfaces of the at least one engagement element, thereby creating friction which holds the second element in position relative to the first element, while permitting the second element to be moved to different positions relative to the first element. In some embodiments, the spring-loaded arms can be attached to the second element and the at least one engagement element can be attached to the first element. In other embodiments, the spring-loaded arms can be attached to the first element and the at least one engagement element can be attached to the second element. The spring-loaded arms can be spring-biased apart from each other (e.g., into contact with opposite sides of a generally C-shaped engagement element), or they can be spring-biased toward each other (e.g., into contact with opposite sides of a block-shaped engagement element). In some embodiments, the spring-loaded arms can be slid relative to the engagement element while maintaining sufficient friction with the engagement element that the second element can be held in position at many locations (or all locations) along the range over which the spring-loaded arms can be slid relative to the engagement element. In some embodiments, the spring-loaded arms can have a hook at a remote location, which can prevent the second element from being moved away from the first element beyond a desired extreme location.

Another representative example of a suitable position-retaining element is a telescoping element, i.e., an element that has at least two sections that telescope relative to each other, the first element being connected to one section, the second element being connected to another section.

Another representative example of a suitable position-retaining element is an axial spring, where the first element is connected to a first region (e.g., one end) of the axial spring and the second element is connected to a second region (e.g., the other end) of the axial spring. In some embodiments, the first element can be attached to a first portion of a light fixture, and the second element can be biased toward the first element by the axial spring into engagement with a second portion of the light fixture or with a construction element to which the fixture is attached (e.g., the trim can be biased by the axial spring upward into engagement with a ceiling in which the fixture is mounted).

Another representative example of a suitable position-retaining element is a ratcheting element in which: a ratcheting portion can be pushed in a first direction relative to a ratcheting receptacle but not in an opposite direction, the first element is connected to one of the ratcheting portion and the ratcheting receptacle, and the second element is connected to the other of the ratcheting portion and the ratcheting receptacle, whereby the second element can be incrementally moved in one direction (but not the other direction) relative to the first element.

Another representative example of a suitable position-retaining element is a retracting reel, in which: a reel is spring biased to rotate in a direction in which it would wind up a cable, one of the first and second elements is connected to the reel and the other of the first and second elements is connected to the cable, whereby the element connected to the cable can be moved away from the other element by a force which causes the cable to wind out of the reel, and the spring bias of the reel biases the first and second elements toward each other. For example, in some embodiments, the first element can be attached to a first portion of a light fixture, and the second element can be biased toward the first element by the reel into engagement with a second portion of the light fixture or with a construction element to which the fixture is attached (for instance, the trim element can be biased by the reel upward so that a lower flange of the trim is biased into engagement with a ceiling in which the fixture is mounted).

In some embodiments, the second element can be substantially continuously movable relative to the first element over a range of positions, i.e., the distance between the first element and second element can be any value between the largest and smallest values, e.g., in the case of the spring retained clip(s), the telescoping element(s), the axial spring element(s) and the retracting reel(s) (but not in the case of the ratcheting element).

Some embodiments according to the present inventive subject matter comprise a trim element. The trim element, when included, can be of any suitable shape and size, and can be made of any suitable material or materials. Representative examples of materials that can be used for making a trim element include, among a wide variety of other materials, spun aluminum, stamped aluminum, die cast aluminum, rolled or stamped steel, hydroformed aluminum, injection molded metal, iron, injection molded thermoplastic, compression molded or injection molded thermoset, glass (e.g., molded glass), ceramic, liquid crystal polymer, polyphenylene sulfide (PPS), clear or tinted acrylic (PMMA) sheet, cast or injection molded acrylic, thermoset bulk molded compound or other composite material. In some embodiments that include a trim element, the trim element can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

Some embodiments in accordance with the present inventive subject matter include one or more lenses or diffusers. Persons of skill in the art are familiar with a wide variety of lenses and diffusers, can readily envision a variety of materials out of which a lens or a diffuser can be made, and are familiar with and/or can envision a wide variety of shapes that lenses and diffusers can be. Any of such materials and/or shapes can be employed in a lens and/or a diffuser in an embodiment that includes a lens and/or a diffuser. As will be understood by persons skilled in the art, a lens or a diffuser in a lighting device according to the present inventive subject matter can be selected to have any desired effect on incident light (or no effect), such as focusing, diffusing, etc.

In embodiments in accordance with the present inventive subject matter that include a diffuser (or plural diffusers), the diffuser (or diffusers) can be positioned in any suitable location and orientation.

In embodiments in accordance with the present inventive subject matter that include a lens (or plural lenses), the lens (or lenses) can be positioned in any suitable location and orientation.

Some embodiments in accordance with the present inventive subject matter include one or more mixing chamber element, which defines at least a portion of a mixing chamber in which light from one or more light sources is mixed before exiting the lighting device. A mixing chamber element, when included, can be of any suitable shape and size, and can be made of any suitable material or materials. Representative examples of materials that can be used for making a mixing chamber element include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments that include a mixing chamber element, the mixing chamber element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®. In some embodiments that include a mixing chamber, the mixing chamber is defined (at least in part) by a mixing chamber element and a lens and/or diffuser.

In some embodiments that include a mixing chamber, the mixing chamber is defined (at least in part) by a trim element (e.g., instead of or in addition to a mixing chamber element). In some embodiments that include a mixing chamber, the mixing chamber is defined (at least in part) by a trim element, along with a mixing chamber element, a lens and/or a diffuser.

In some embodiments according to the present inventive subject matter, the lighting device can comprise a mixing chamber element (i.e., an element that defines a region in which light emitted by the one or more light sources can mix), or the trim element can comprise a mixing chamber element (e.g., the mixing chamber element can be integral with the trim element, and/or the trim element can comprise a region that functions as a mixing chamber).

In some embodiments according to the present inventive subject matter, a single structure can be provided which acts as the trim element and as a mixing chamber element. In some embodiments, such structure can also comprise some or all of the thermal management system for the lighting device. By providing such a structure, it is possible to reduce or minimize the thermal interfaces between the light source(s) and the ambient environment (and thereby improve heat transfer), especially, in some cases, in devices in which the trim element acts as a heat sink for light source(s) (e.g., solid state light emitters) and is exposed to a room. In addition, such a structure can eliminate one or more assembly steps, and/or reduce parts count. In such lighting devices, the structure (i.e., the combined trim element and mixing chamber element) can further comprise one or more reflector and/or reflective film, with the structural aspects of the mixing chamber being provided by the trim element (i.e., by the combined trim element and mixing chamber).

The lighting devices of the present inventive subject matter can be arranged in generally any suitable orientation, a variety of which are well known to persons skilled in the art. For example, the lighting device can be a back-reflecting device or a front-emitting device.

The lighting devices according to the present inventive subject matter can employ any suitable heat dissipation scheme, a wide variety of which (e.g., one or more heat dissipation structures) are well known to persons skilled in the art and/or which can readily be envisioned by persons skilled in the art. Representative examples of heat dissipation schemes which might be suitable are described in:

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 12/411,905, filed on Mar. 26, 2009 (now U.S. Patent Publication No. 2010/0246177), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety; and U.S. patent application Ser. No. 12/566,850, filed on Sep. 25, 2009, entitled "Lighting Device With One Or More Removable Heat Sink Elements" (now U.S. Patent Publication No. 2011/0074265), the entirety of which is hereby incorporated by reference as if set forth in its entirety.

Any suitable circuitry (including any suitable electronic components) can be employed in order to supply energy to the one or more light sources according to the present inventive subject matter. Representative examples of circuitry which may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety;

U.S. patent application Ser. No. 12/566,142, filed on Sep. 24, 2009, entitled "Solid State Lighting Apparatus With Configurable Shunts" (now U.S. Patent Publication No. 2011-0068696), the entirety of which is hereby incorporated by reference as if set forth in its entirety; and U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011-0068702), the entirety of which is hereby incorporated by reference as if set forth in its entirety.

For example, solid state lighting systems have been developed that include a power supply that receives the AC line voltage and converts that voltage to a voltage and/or current suitable for driving solid state light emitters. Typical power supplies for light emitting diode light sources include linear current regulated supplies and/or pulse width modulated current and/or voltage regulated supplies.

A driver can comprise one or more electrical components employed in driving one or more light source, e.g., running one or more light source intermittently and/or adjusting the current supplied to one or more light sources in response to a user command, a detected change in intensity or color of light output, a detected change in an ambient characteristic such as temperature or background light, etc., and/or a signal contained in the input power (e.g., a dimming signal in AC power supplied to the lighting device).

In some embodiments of lighting devices according to the present inventive subject matter, a power supply can be provided in the first element. In some embodiments of lighting devices according to the present inventive subject matter, a power supply can be provided in the second element. In some embodiments of lighting devices according to the present inventive subject matter, a power supply can be provided elsewhere, i.e., not in the first element or the second element (e.g., not in the lighting device). In some embodiments of lighting devices according to the present inventive subject matter, some components of a power supply can be provided in the first element, and other components of a power supply can be provided in the second element.

In some embodiments of lighting devices according to the present inventive subject matter, a driver can be provided in the first element. In some embodiments of lighting devices according to the present inventive subject matter, a driver can be provided in the second element. In some embodiments of lighting devices according to the present inventive subject matter, a driver can be provided elsewhere, i.e., not in the first element or the second element (e.g., not in the lighting device). In some embodiments of lighting devices according to the present inventive subject matter, some components of a driver can be provided in the first element, and other components of a driver can be provided in the second element.

In other words, any component or components of the power supply and/or the driver can be provided in the first element and/or the second element, or in neither. Such components can include, for example, (1) one or more electrical components employed in converting electrical power (e.g., from AC to DC), (2) one or more electrical components employed in driving one or more light source, e.g., running one or more light source intermittently and/or adjusting the current supplied to one or more light sources in response to a user command, a detected change in intensity or color of light output, a detected change in an ambient characteristic such as temperature or background light, etc., and/or a signal contained in the input power (e.g., a dimming signal in AC power supplied to the lighting device), etc., (3) one or more circuit boards (e.g., a metal core circuit board) for supporting any electrical components, (4) one or more wires connecting any components (e.g., connecting an Edison socket to a circuit board), etc.

Many different techniques have been described for driving solid state light sources in many different applications, including, for example, those described in U.S. Pat. No. 3,755,697 to Miller, U.S. Pat. No. 5,345,167 to Hasegawa et al, U.S Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Possum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Bergjohansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Patent No. 6,614,358 to Hutchison et al, U.S. Patent No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

In addition, one or more scattering elements (e.g., layers) can optionally be included in the lighting devices according to this aspect of the present inventive subject matter. The scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

Energy can be supplied to the electrical connector of the first element via a corresponding connector (i.e., a connector that engages the electrical connector, e.g., an Edison socket where the electrical connector is an Edison plug) from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

The various components in the lighting devices can be mounted in any suitable way. For example, in some embodiments, light emitting diodes can be mounted on a first circuit board (a "light emitting diode circuit board") and electronic circuitry that can convert AC line voltage into DC voltage suitable for being supplied to light emitting diodes can be mounted on a second circuit board (a "driver circuit board"), whereby line voltage is supplied to the electrical connector and passed along to the driver circuit board, the line voltage is converted to DC voltage suitable for being supplied to light emitting diodes in the driver circuit board, and the DC voltage is passed along to the light emitting diode circuit board where it is then supplied to the light emitting diodes.

In any lighting device in accordance with the present inventive subject matter that comprises one or more solid state light emitters (e.g., one or more light emitting diodes), the solid state light emitter, or one or more of the solid state light emitters, can be mounted directly on the trim element (and/or, when a mixing chamber element is included, directly on the mixing chamber element). In such devices, power can be delivered to the solid state light emitter or solid state light emitters that is/are mounted directly on the trim element (and/or on a mixing chamber element) in any suitable way, e.g., through conductive traces provided on the trim element (and/or on a mixing chamber element), through wires connected to one or more circuit boards, through traces embedded in the trim element (and/or a mixing chamber element), through contacts that extend through the trim element (and/or a mixing chamber element), etc.

Mounting solid state light emitters directly on the trim element (and/or on a mixing chamber element) can reduce or minimize the thermal interfaces between the solid state light emitters and the ambient environment where the trim element (and/or a mixing chamber element) acts as a heat sink for the solid state light emitters and is exposed to a room. Mounting solid state light emitters directly on the trim element (and/or on a mixing chamber element) can also eliminate the cost of a metal core circuit board. In other devices, one or more solid state light emitters could be mounted on a circuit board (e.g., a metal core circuit board) that is mounted on the trim element (and/or a mixing chamber element).

In some lighting devices in which the solid state light emitter or one or more of the solid state light emitters is/are mounted directly on the trim element, one or more thermal element can be provided that is on the trim element in a location where it can serve a specific solid state light emitter or group of solid state light emitters. A representative example of a suitable thermal element is a projection that extends from the side of the trim element that is opposite the side on which the solid state light emitter(s) is/are mounted. Alternatively or additionally a portion of the heat sink adjacent to the solid state light emitter (or solid state light emitters) can be removed (and optionally filled with a thermal element or a part of a thermal element). A thermal element can be made of any suitable material, and can be of any suitable shape. Use of materials having higher heat conductivity in making the thermal element(s) generally provides greater heat transfer, and use of thermal element(s) of larger surface area and/or cross-sectional area generally provides greater heat transfer. Representative examples of materials that can be used to make the thermal element(s), if provided, include metals, diamond, DLC, etc.

The present inventive subject matter is also directed to a light fixture that comprises at least one lighting device as described herein. The light fixture can comprise a housing, a mounting structure, and/or an enclosing structure. Persons of skill in the art are familiar with, and can envision, a wide variety of materials out of which a fixture, a housing, a mounting structure and/or an enclosing structure can be constructed, and a wide variety of shapes for such a fixture, a housing, a mounting structure and/or an enclosing structure. A fixture, a housing, a mounting structure and/or an enclosing structure made of any of such materials and having any of such shapes can be employed in accordance with the present inventive subject matter.

In some embodiments, the fixture further comprises an electrical connector that engages (and/or is configured to engage) the electrical connector on the lighting device electrically and/or mechanically, e.g., the electrical connector connected to the fixture is complementary to the electrical connector connected to the lighting device (for example, the fixture can comprise an Edison socket into which an Edison plug on the lighting device is receivable, the fixture can comprise a GU24 socket into which GU24 pins are receivable, etc.).

In some embodiments, the electrical connector that engages the electrical connector on the lighting device is substantially non-moving relative to the fixture housing, e.g., the force normally employed when installing an Edison plug in an Edison socket does not cause the Edison socket to move more than one centimeter relative to the housing, and in some embodiments, not more than ½ centimeter (or not more than ¼ centimeter, or not more than one millimeter, etc.). In some embodiments, the electrical connector that engages the electrical connector on the lighting device can be secured to two or more different locations on the fixture housing (in each of which, once secured, it is substantially non-moving relative to the fixture housing, but if desired, can be removed, e.g., by loosening and/or removing a wingnut, and if desired attached to another location).

For example, fixtures, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety;

U.S. patent application No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety; and U.S. patent application Ser. No. 12/469,828, filed on May 21, 2009 (now U.S. Patent Publication No. 2010/0103678), the entirety of which is hereby incorporated by reference as if set forth in its entirety.

Some embodiments in accordance with the present inventive subject matter can comprise a power line that can be connected to a source of power (such as a branch circuit, a battery, a photovoltaic collector, etc.) and that can supply power to the electrical connector. Persons of skill in the art are familiar with, and have ready access to, a variety of structures that can be used as a power line. A power line can be any structure that can carry electrical energy and supply it to an electrical connector on a fixture and/or a lighting device according to the present inventive subject matter.

The lighting devices according to the present inventive subject matter can further comprise elements that help to ensure that the perceived color (including color temperature) of the light exiting the lighting device is accurate (e.g., within a specific tolerance). A wide variety of such elements and combinations of elements are known, and any of them can be employed in the lighting devices according to the present inventive subject matter. For instance, representative examples of such elements and combinations of elements are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

As noted above, the present inventive subject matter relates to a method of installing a lighting device, the method comprising connecting a first electrical connector of a first element to a second electrical connector, and positioning a second element that comprises at least one light source relative to the first element by engaging a position-retaining element, that is attached to one of the first element and the second element, to the other of the first element and the second element.

In some methods according to the present inventive subject matter, the position-retaining element holds the second element in any of at least two positions relative to the first element.

In some methods according to the present inventive subject matter, the second element is movable relative to the first element among the positions.

Some methods according to the present inventive subject matter further comprise removing an electrical connector of a light device (e.g., a used lighting device that is being replaced) from the second electrical connector before connecting the first electrical connector to the second electrical connector. In most instances where a lighting device is being replaced, the entire lighting device will be removed from the light fixture (or other structure that provides the second electrical connector) before installing the new lighting device (i.e., a device in accordance with the present inventive subject matter).

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 2:
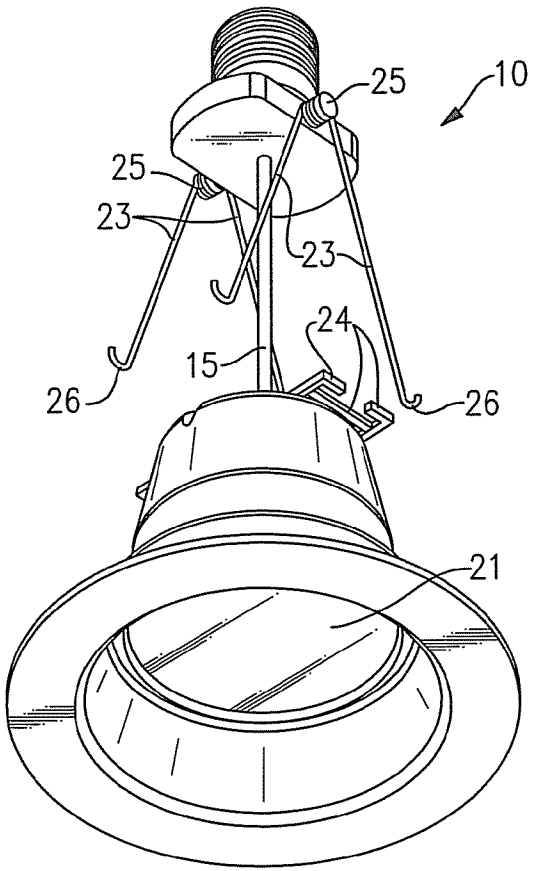
FIG. 2 is a second perspective view of the lighting device 10.
Figure 1:
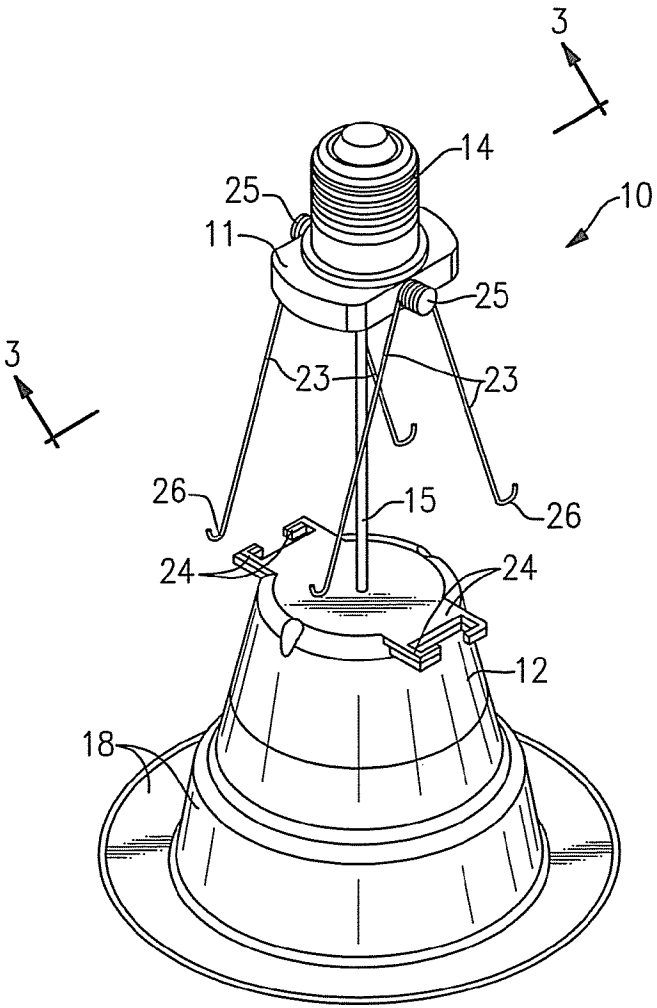
FIG. 1 is a first perspective view of a lighting device 10 in accordance with the present inventive subject matter.
Figure 3:
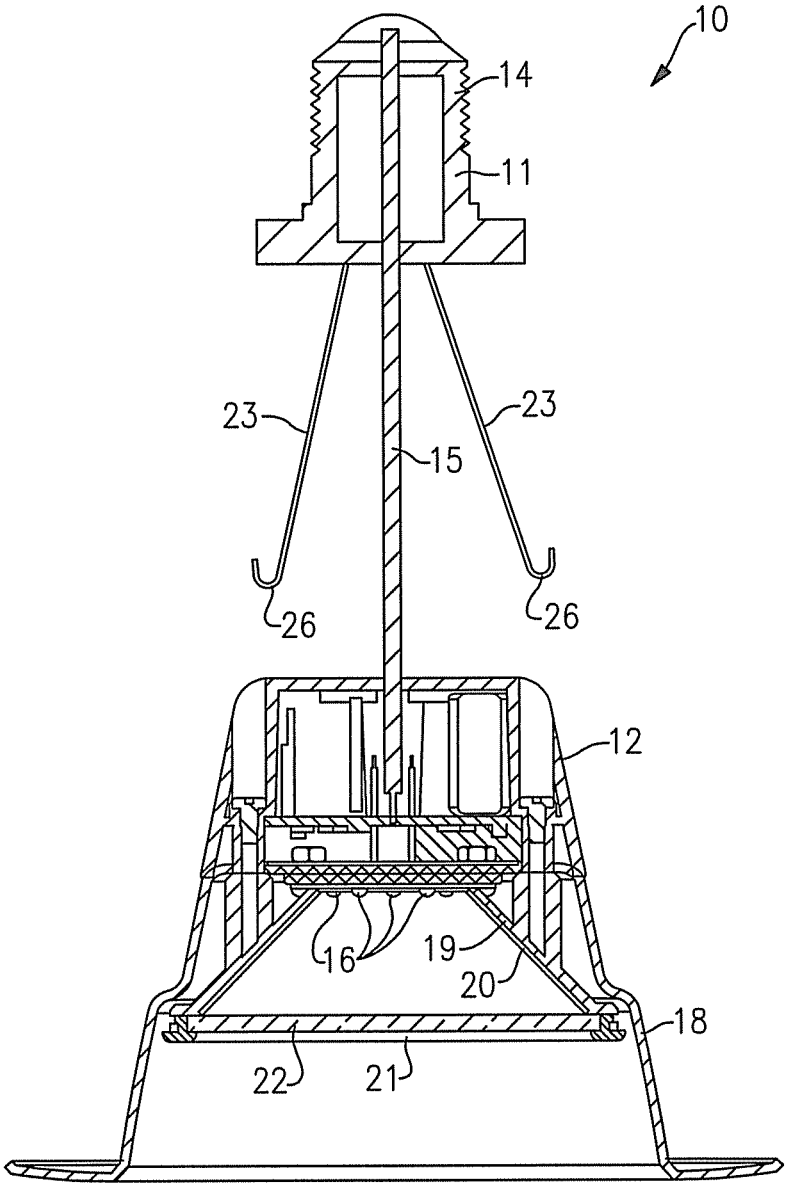
FIG. 3 is a sectional view of the lighting device 10 along the plane 3-3 depicted in FIG. 1.

FIGS. 1-3 schematically depict a lighting device 10 in accordance with the present inventive subject matter. FIG. 1 is a first perspective view of the lighting device 10. FIG. 2 is a second perspective view of the lighting device 10. FIG. 3 is a sectional view of the lighting device 10 along the plane 3-3 depicted in FIG. 1.

The lighting device 10 comprises a first element 11, and second element 12 and position-retaining elements (described below).

The first element 11 comprises an electrical connector 14. In the embodiment depicted in FIGS. 1-3, the electrical connector 14 is an Edison plug, but it can alternatively be any other suitable electrical connector.

The second element 12 comprises a plurality of light sources 16, a trim element 18, a mixing chamber element 19, a reflector sheet 20, a lens 21 and a diffuser film 22.

In the embodiment depicted in FIGS. 1-3, the second element 12 comprises a plurality of light sources 16, but the second element 12 can alternatively comprise any suitable number of light sources. In the embodiment depicted in FIGS. 1-3, the light sources 16 are light emitting diodes, but the light source(s) can alternatively be any type of light sources or any combination of any types of light sources.

A wire 15 is included and is part of the sequence of structures that provides electrical connection between the electrical connector 14 and the light sources 16.

The embodiment depicted in FIGS. 1-3 includes two positioning-retaining elements, each of which comprises a spring-retaining clip that includes a pair of spring-loaded arms 23 and an engagement element 24. Each pair of spring-loaded arms 23 are part of a spring element positioned on a respective position-retaining element support 25 provided on the first element 11. The respective engagement elements 24 are positioned on the second element 12.

The spring-loaded arms 23 are spring-biased apart from each other into contact with opposite sides of the respective generally C-shaped engagement element 24. The spring-loaded arms 23 can be slid relative to the respective engagement element 24 while maintaining sufficient friction with the engagement element 24 that the second element 12 is held in position (relative to the first element 11) at virtually any location along the range over which the spring-loaded arms 23 can be slid relative to the engagement elements 24.

In the embodiment depicted in FIGS. 1-3, each of the spring-loaded arms 23 has a hook region 26 at a remote location, which can prevent the second element 12 from being moved away from the first element 11 beyond a desired extreme location (e.g., it can prevent the second element 12 from exerting undue downward force on the wire 15).

Figure 4:
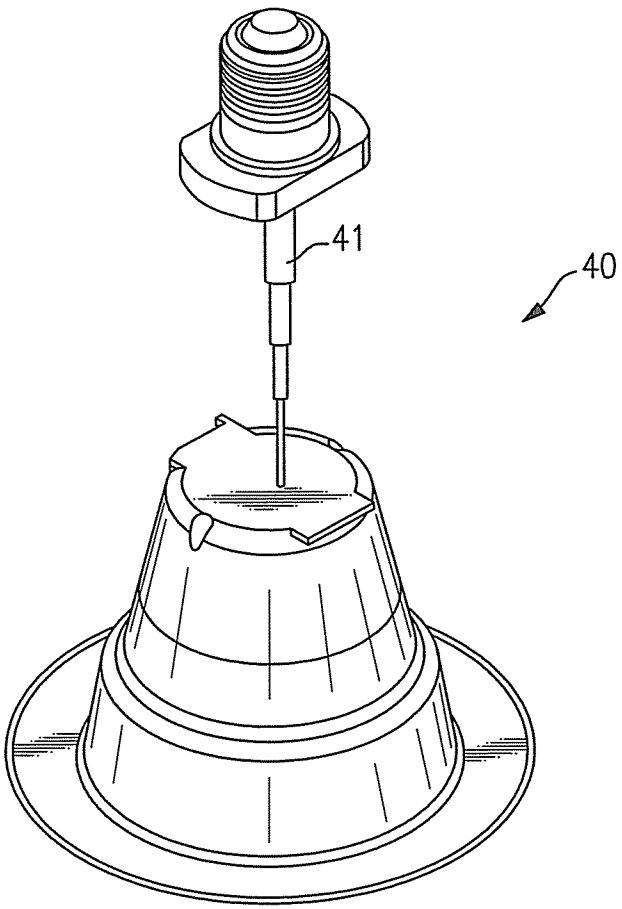
FIG. 4 depicts a lighting device 40 in accordance with the present inventive subject matter.

FIG. 4 depicts a lighting device 40 in accordance with the present inventive subject matter. The embodiment depicted in FIG. 4 is similar to the embodiment depicted in FIGS. 1-3, except that the embodiment depicted in FIG. 4 includes a telescoping element 41 (within which the wire is positioned) as the position-retaining element (instead of spring-retaining clips as provided in the embodiment depicted in FIGS. 1-3).

Figure 5:
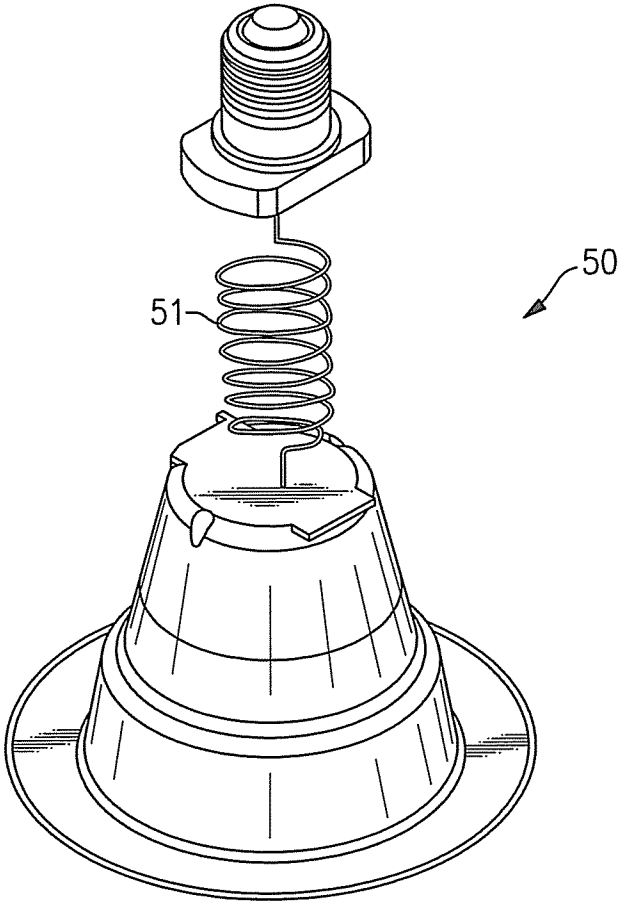
FIG. 5 depicts a lighting device 50 in accordance with the present inventive subject matter.

FIG. 5 depicts a lighting device 50 in accordance with the present inventive subject matter. The embodiment depicted in FIG. 5 is similar to the embodiment depicted in FIGS. 1-3, except that the embodiment depicted in FIG. 5 includes an axial spring 51 (within which the wire is positioned) as the position-retaining element (instead of spring-retaining clips as provided in the embodiment depicted in FIGS. 1-3).

Figure 6:
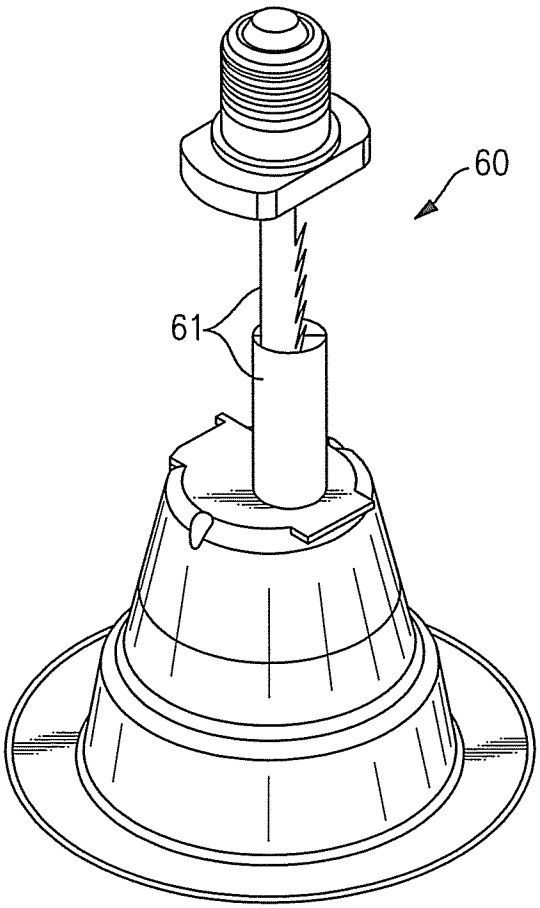
FIG. 6 depicts a lighting device 60 in accordance with the present inventive subject matter.

FIG. 6 depicts a lighting device 60 in accordance with the present inventive subject matter. The embodiment depicted in FIG. 6 is similar to the embodiment depicted in FIGS. 1-3, except that the embodiment depicted in FIG. 6 includes a ratcheting element 61 as the position-retaining element (instead of spring-retaining clips as provided in the embodiment depicted in FIGS. 1-3).

Figure 7:
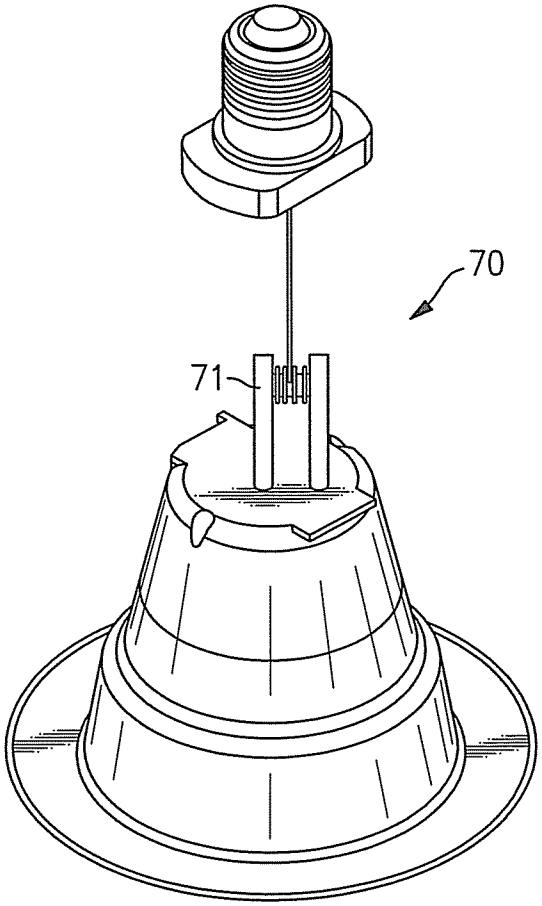
FIG. 7 depicts a lighting device 70 in accordance with the present inventive subject matter.

FIG. 7 depicts a lighting device 70 in accordance with the present inventive subject matter. The embodiment depicted in FIG. 7 is similar to the embodiment depicted in FIGS. 1-3, except that the embodiment depicted in FIG. 7 includes a retracting reel 71 as the position-retaining element (instead of spring-retaining clips as provided in the embodiment depicted in FIGS. 1-3).

Figure 8:
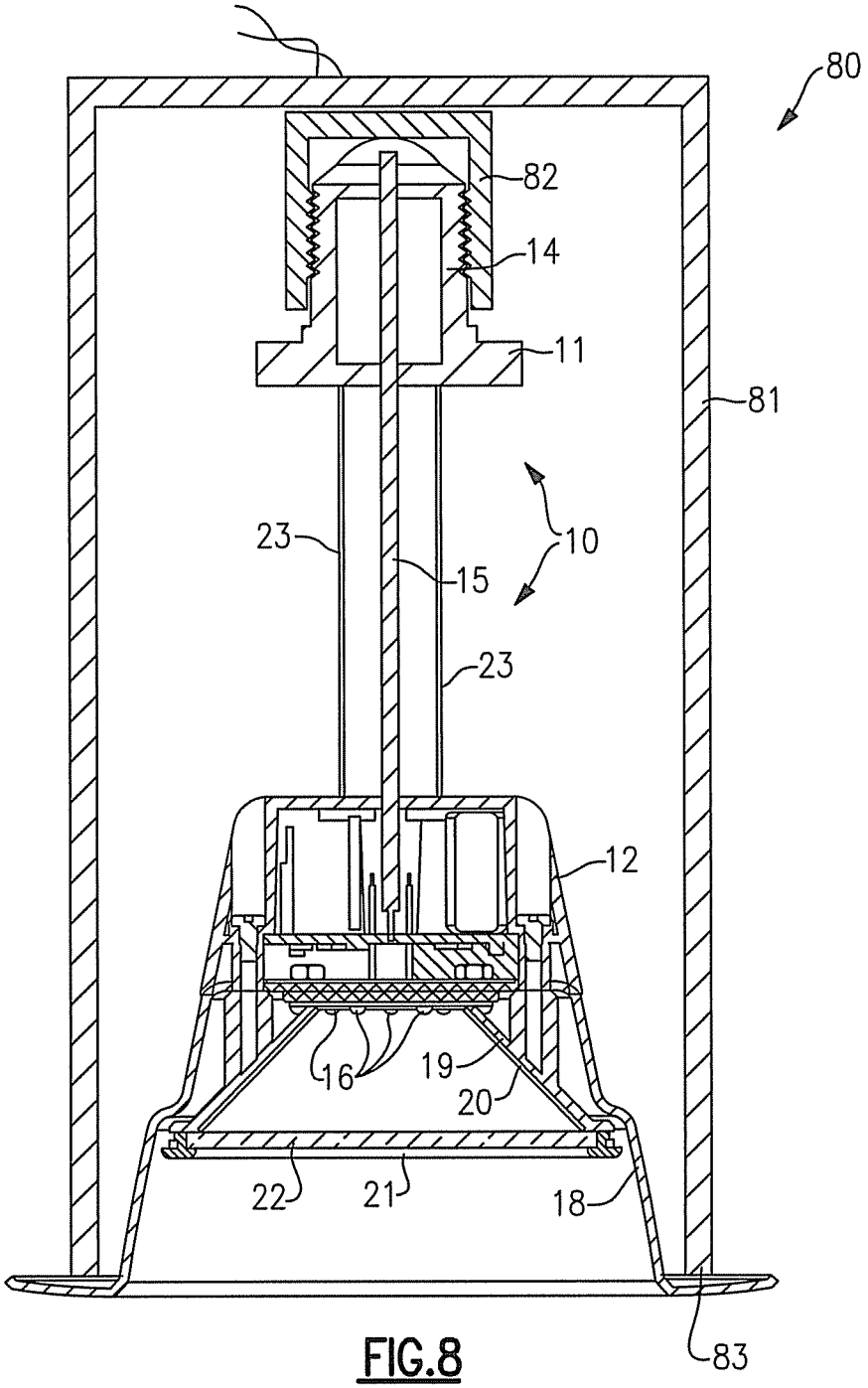
FIG. 8 depicts a light fixture in accordance with the present inventive subject matter.

FIG. 8 depicts a light fixture 80 in accordance with the present inventive subject matter. The light fixture 80 comprises a lighting device 10 as depicted in FIGS. 1-3, as well as a housing 81 and an electrical connector 82. The electrical connector 14 of the lighting device 10 holds the first element 11 in place relative to the housing 81, and the spring-retaining clips (i.e., each of which comprises a pair of spring-loaded arms 23 and an engagement element, not visible in FIG. 8) hold the second element 12 in place relative to the first element 11, as a result of which the trim element 18 is held in contact with a first end 83 of the housing 81.

FIGS. 9-15 schematically depict a lighting device 100 in accordance with the present inventive subject matter.

Figure 9:
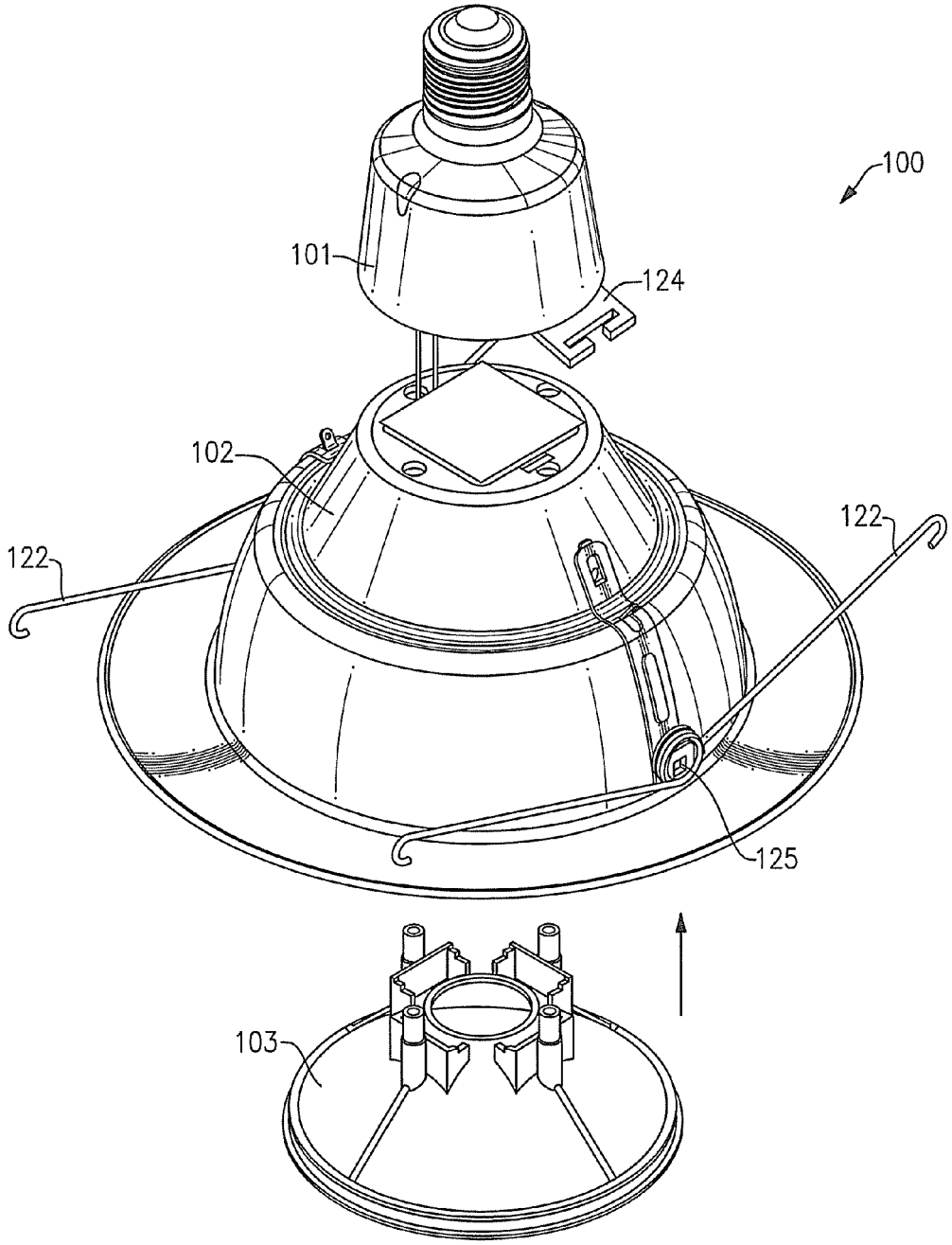

FIG. 9 is an exploded perspective view of the lighting device 100.

The lighting device 100 (see FIG. 9) comprises a driver sub-assembly 101, a trim sub-assembly 102 and a mixing chamber sub-assembly 103.

Figure 10:
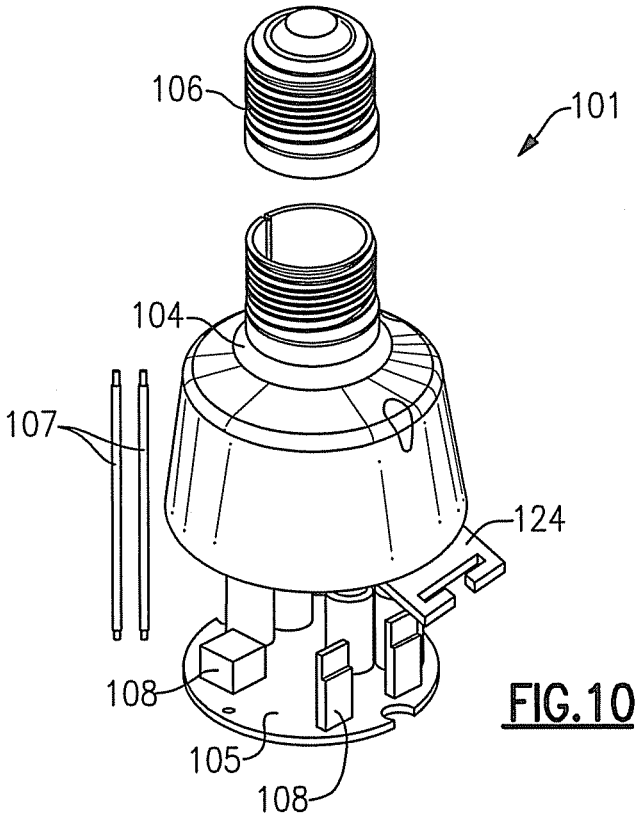
Figure 11:
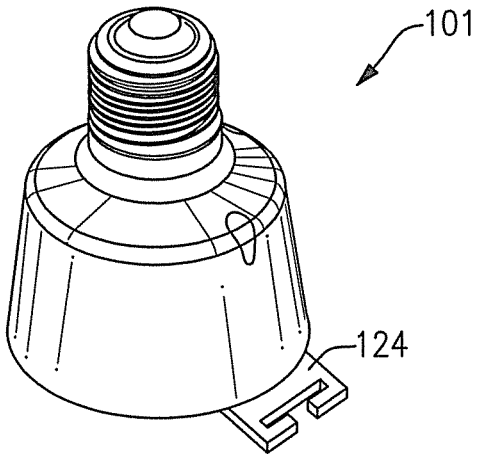

FIG. 10 is an exploded perspective view of the driver sub-assembly 101, and FIG. 11 is a perspective view of the driver sub-assembly 101.

Figure 12:
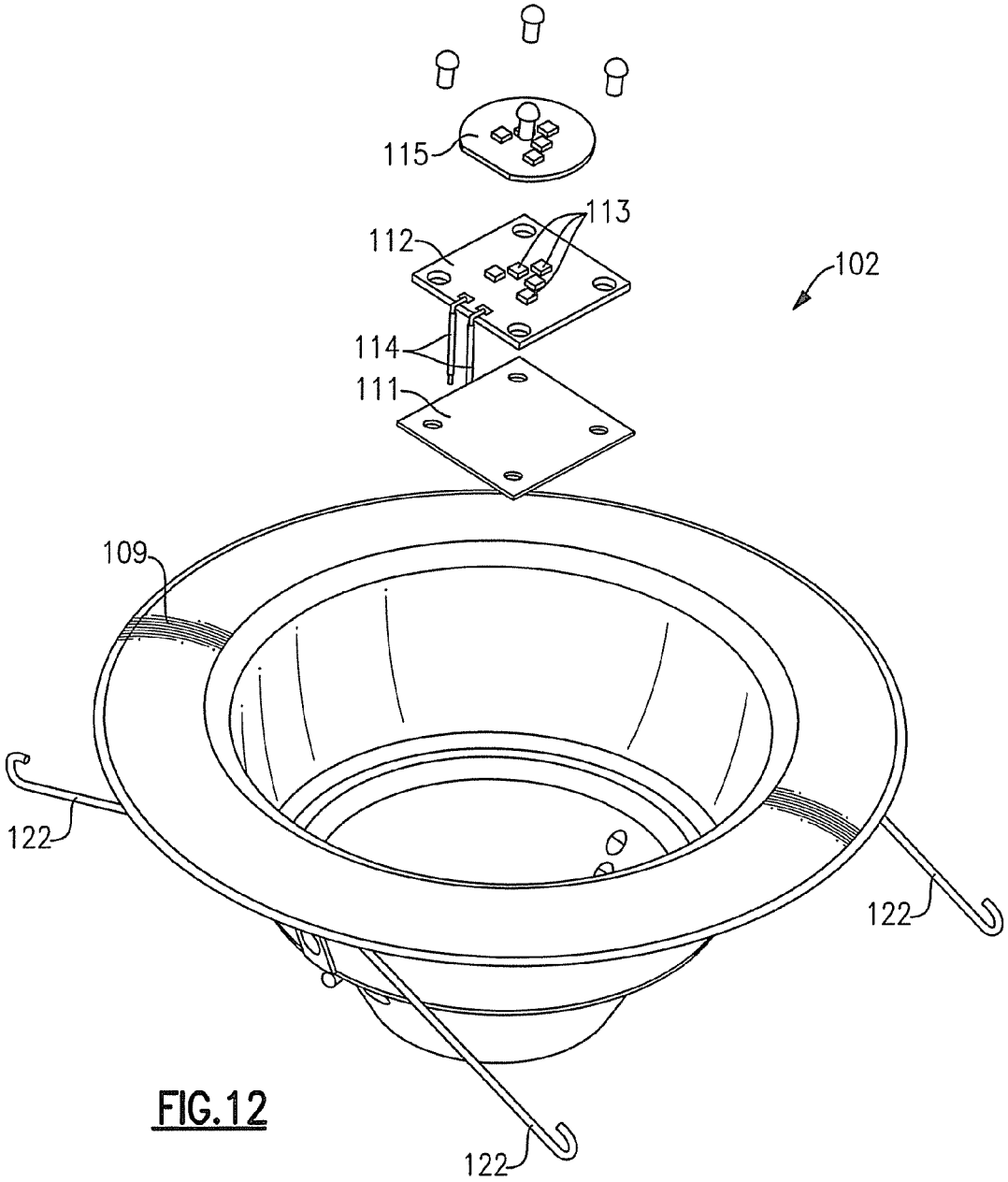
Figure 13:
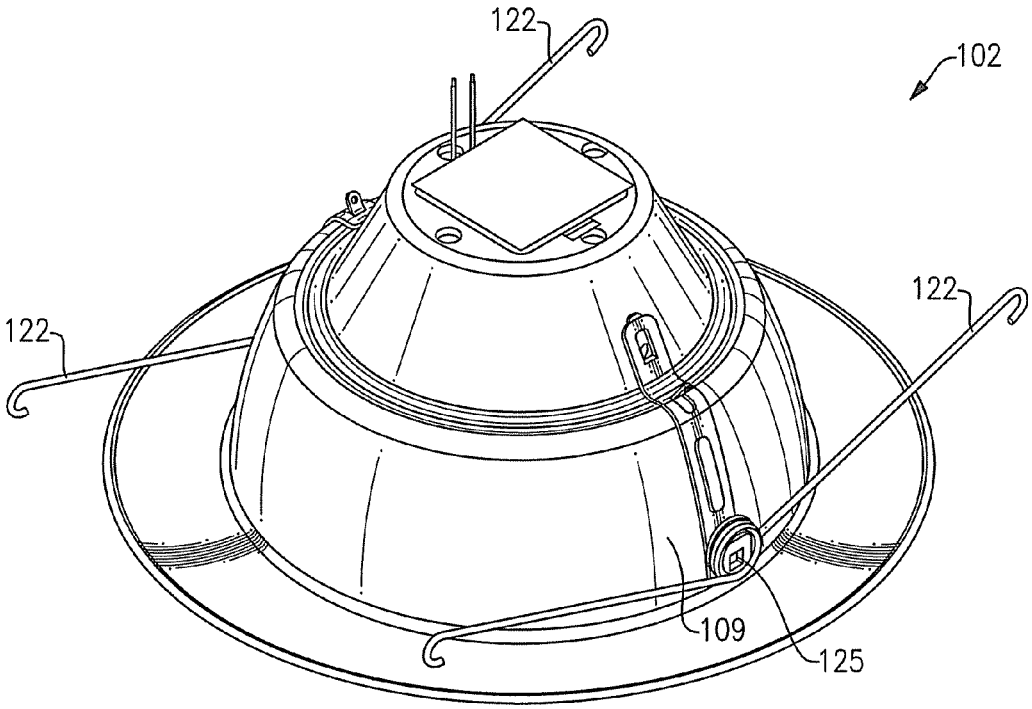

FIG. 12 is an exploded perspective view of the trim sub-assembly 102, and FIG. 13 is a perspective view of the trim sub-assembly 102.

Figure 14:
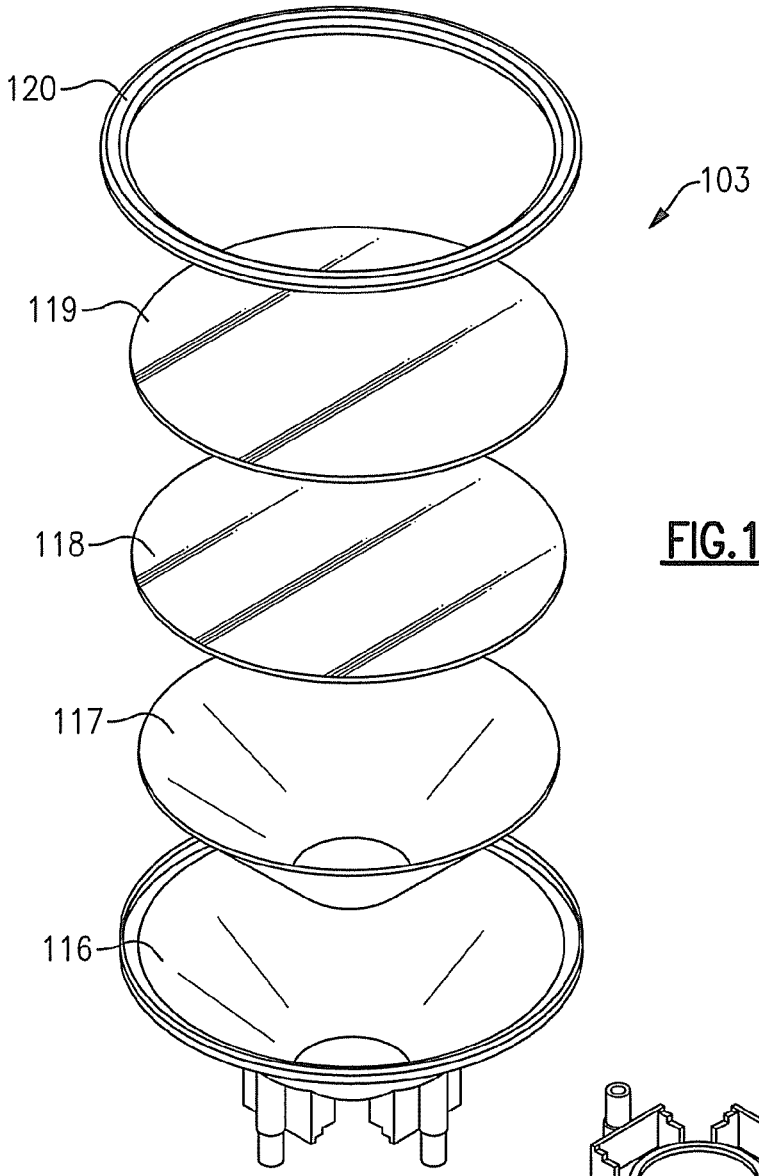
Figure 15:
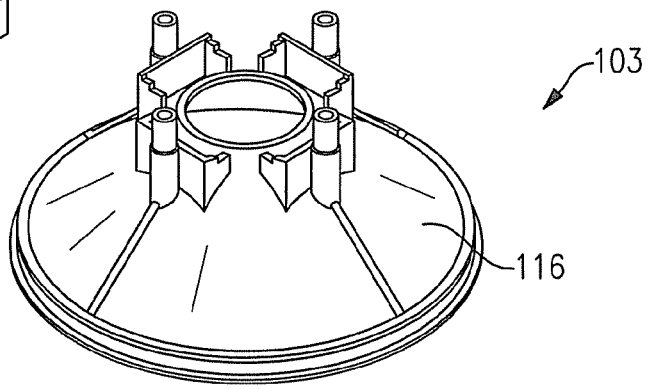

FIG. 14 is an exploded perspective view of the mixing chamber sub-assembly 103, and FIG. 15 is a perspective view of the mixing chamber sub-assembly 103.

The driver sub-assembly (first element) 101 (see FIG. 10) comprises a housing 104, a driver circuit board 105, an Edison screw 106 and input wires 107. A plurality of circuitry components 108 are mounted on the driver circuit board 105. In this embodiment, the housing 104 is made of plastic, but alternatively it can be made of any other suitable material or materials.

The trim sub-assembly 102 (second element)(see FIG. 12) comprises a trim element 109, a thermally conductive pad 111, a light emitting diode circuit board 112, a plurality of light emitting diodes 113 (mounted on the light emitting diode circuit board 112), light emitting diode board wires 114 and a reflector sheet 115. If desired, electrical insulation (e.g., any suitable material for providing ample electrical insulation between the driver circuit board 105 and the light emitting diode circuit board 112, e.g., electrical insulation tape, Formex sheet, etc.) can be provided.

The mixing chamber sub-assembly 103 (see FIG. 14) comprises a mixing chamber element 116, a mixing chamber reflector 117, a diffuser film 118, a lens 119 and a lens retainer 120. In this embodiment, the mixing chamber element 116 is made of plastic, but alternatively it can be made of any other suitable material or materials. In this embodiment, the lens 119 is made of glass, but alternatively it can be made of any other suitable material or materials. The lens retainer 120 can be of any suitable design, e.g., as described in:

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety; and U.S. patent application Ser. No. 11/948,041, filed Nov. 30, 2007 (now U.S. Patent Publication No. 2008/0137347), the entirety of which is hereby incorporated by reference as if set forth in its entirety.

The embodiment depicted in FIGS. 9-15 includes two positioning-retaining elements, each of which is a spring-retaining clip that includes a pair of spring-loaded arms 122 and an engagement element 124. Each pair of spring-loaded arms 122 are part of a spring element positioned on a respective position-retaining element support 125 provided on the trim sub-assembly (second element) 102. The respective engagement elements 124 are positioned on the driver sub-assembly (first element) 101.

The spring-loaded arms 122 are spring-biased apart from each other into contact with opposite sides of the respective generally C-shaped engagement element 124. The spring-loaded arms 122 can be slid relative to the respective engagement element 124 while maintaining sufficient friction with the engagement element 124 that the trim sub-assembly 102 is held in position at virtually any location along the range over which the spring-loaded arms 122 can be slid relative to the engagement elements 124.

The driver sub-assembly 101 can be assembled by soldering one end of each of the input wires 107 to the driver circuit board 105, inserting the driver circuit board 105 into the housing 104, soldering the other end of each of the input wires 107 to the Edison screw 106, and gluing the Edison screw 106 to the housing 104.

The trim sub-assembly 102 can be assembled by positioning trim sub-assembly nuts (into which trim sub-assembly bolts will be received, as described later) in an assembly jig, placing the trim element 109 in the assembly jig, and soldering the light emitting diode board wires 114 to the light emitting diode circuit board 112. The wires between the driver and the light emitting diode circuit board 112 can previously have been connected to the driver circuit board 105 (i.e., prior to assembly of the driver sub-assembly). The end of the wire that is connected to the light emitting diode circuit board 112 may include a connector to allow for easy connection to the light emitting diode circuit board 112, or it can be soldered to save cost. Alternatively, the wires may be soldered to the light emitting diode circuit board 112 and may have a connecter at the end that connects to the driver circuit board 105 (and/or to a driver end of a power supply unit), in which case the cable and the connector could plug into a mating socket on the underside of the driver circuit board 105. Then, placing the thermal pad 111 and the light emitting diode circuit board 112 in the trim element 109, inserting trim sub-assembly bolts through holes in the light emitting diode circuit board 112 and through corresponding holes in the thermal pad 111 and into the trim sub-assembly nuts, and applying the reflector sheet 115 onto the light emitting diode circuit board 112 (with the illumination surfaces of the light emitting diodes 113 aligned with corresponding openings in the reflector sheet 115). Instead of the trim sub-assembly bolts and trim sub-assembly nuts, any other connecting elements can be employed, e.g., spring clips, screws, rivets, adhesive, etc.

The mixing chamber sub-assembly 103 can be assembled by placing the mixing chamber reflector 117 on the mixing chamber element 116, placing the diffuser film 118 and the lens 119 in the mixing chamber element 116, and snap-fitting the lens retainer 120 on the mixing chamber element 116. In some embodiments, the mixing chamber reflector 117 may be attached to the mixing chamber element 116, for example, by press fitting or by an adhesive to secure the mixing chamber reflector 117 to the mixing chamber element 116.

The lighting device 100 can be assembled and installed by placing the mixing chamber sub-assembly 103 in an assembly jig, placing the trim sub-assembly 102 in the assembly jig, soldering the light emitting diode board wires 114 to the driver circuit board 105, inserting screws through openings provided in the trim sub-assembly 102 and into corresponding holes provided in the mixing chamber sub-assembly 103 and tightening the screws down (instead of the screws, any other connecting elements can be employed, e.g., nut and bolt combinations, spring clips, rivets, adhesive, etc.). Then the Edison screw 106 can be threaded into an Edison socket in a fixture housing and tightened, then the arms 122 can be positioned in the engagement elements 124, and then the lighting device 100 can be positioned relative to the fixture housing by sliding the lighting device 100 such that the arms 122 move up and/or down relative to the engagement elements 124.

FIG. 16 schematically depicts an exploded view of a lighting device 200 in accordance with the present inventive subject matter.

The lighting device 200 depicted in FIG. 16 is similar to the lighting device 100 depicted in FIGS. 9-16, except that in the lighting device 200, each pair of spring-loaded arms 222 are part of a spring element positioned on a respective position-retaining element support 225 provided on the driver sub-assembly (first element) 201, and the respective engagement elements 224 are positioned on the trim sub-assembly (second element) 202.

The spring-loaded arms 222 are spring-biased apart from each other into contact with opposite sides of the respective generally C-shaped engagement element 224. The spring-loaded arms 222 can be slid relative to the respective engagement element 224 while maintaining sufficient friction with the engagement element 224 that the second element 202 is held in position at virtually any location along the range over which the spring-loaded arms 222 can be slid relative to the engagement elements 224.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices and light fixtures described herein can be integrated. Any structural part of the lighting devices and light fixtures described herein can be provided in two or more parts (which may be held together in any known way, e.g., with adhesive, screws, bolts, rivets, staples, etc.).

The invention claimed is:

1. A lighting device, comprising:

a first element that comprises a first electrical connector, a second element that comprises at least a first trim element;

a first structure; and a second structure, the first structure engaging the first element and comprising at least two spring-loaded arms, the second structure engaging the second element, the second structure in frictional contact with the first structure and movable relative to the first structure, to hold the second element in any of at least two positions relative to the first element, the first electrical connector electrically connected to at least a first light source, the second element movable relative to the first element among the positions while maintaining electrical connection between the first electrical connector and at least the first light source.

2. A lighting device as recited in claim 1, wherein the lighting device comprises a plurality of light sources, including the first light source.

3. A lighting device as recited in claim 1, wherein the first light source is a solid state light emitter.

4. A lighting device as recited in claim 1, wherein the first light source is a light emitting diode.

5. A lighting device as recited in claim 1, wherein the first electrical connector is an Edison plug.

6. A lighting device as recited in claim 1, wherein the first electrical connector is electrically connected to at least the first light source by a wire.

7. A lighting device as recited in claim 1, wherein the second element further comprises a mixing chamber element and a trim element.

8. A lighting device as recited in claim 1, wherein the second structure is an engagement element, and a first arm and a second arm of the at least two spring-loaded arms are spring-biased apart from each other into contact with opposite sides of the engagement element.

9. A lighting device as recited in claim 1, wherein the first element is substantially continuously movable relative to the second element over a range of positions.

10. A lighting device, comprising:

a first element that comprises a first electrical connector, a second element that comprises at least a first trim element, a first structure; and a second structure, the first structure engaging the second element and comprising at least two spring-loaded arms, the second structure engaging the first element, the second structure in frictional contact with the first structure and movable relative to the first structure, to hold the second element in any of at least two positions relative to the first element, the first electrical connector electrically connected to at least a first light source, the second element movable relative to the first element among the positions while maintaining electrical connection between the first electrical connector and at least the first light source.

11. A lighting device as recited in claim 10, wherein the lighting device comprises a plurality of light sources, including the first light source.

12. A lighting device as recited in claim 10, wherein the first light source is a solid state light emitter.

13. A lighting device as recited in claim 10, wherein the first light source is a light emitting diode.

14. A lighting device as recited in claim 10, wherein the first electrical connector is an Edison plug.

15. A lighting device as recited in claim 10, wherein the first electrical connector is electrically connected to at least the first light source by a wire.

16. A lighting device as recited in claim 10, wherein the second element further comprises a mixing chamber element.

17. A lighting device as recited in claim 10, wherein the first light source is mounted on the second element.

18. A lighting device as recited in claim 10, wherein the second structure is an engagement element, and a first arm and a second arm of the at least two spring-loaded arms are spring-biased apart from each other into contact with opposite sides of the engagement element.

19. A lighting device as recited in claim 10, wherein the first element is substantially continuously movable relative to the second element over a range of positions.

20. A light fixture comprising a housing and the lighting device recited in claim 1.

21. A light fixture as recited in claim 20, wherein:

the housing is substantially cylindrical, a first end of the housing is at least partially open, the lighting device comprises a trim element, and the trim element is held in contact with the first end of the housing.

22. A light fixture comprising a housing and the lighting device recited in claim 10.

23. A light fixture as recited in claim 22, wherein:

the housing is substantially cylindrical, a first end of the housing is at least partially open, and the trim element is held in contact with the first end of the housing.

24. A lighting device, comprising:

a first element that comprises an electrical connector, a second element that comprises at least a first light source, and position-retaining means for holding the second element in any of at least two positions relative to the first element, the position-retaining means comprising at least a first structure and a second structure, the first structure engaging the first element and comprising at least two spring-loaded arms, the second structure engaging the second element, the second structure in frictional contact with the first structure and movable relative to the first structure, the electrical connector electrically connected to at least the first light source, the second element movable relative to the first element among the positions while maintaining electrical connection between the electrical connector and at least the first light source.

25. A lighting device, comprising:

a first element that comprises an electrical connector, a second element that comprises at least a first trim element, and position-retaining means for holding the second element in any of at least two positions relative to the first element, the position-retaining means comprising at least a first structure and a second structure, the first structure engaging the first element and comprising at least two spring-loaded arms, the second structure engaging the second element, the second structure in frictional contact with the first structure and movable relative to the first structure, the electrical connector electrically connected to at least a first light source, the second element movable relative to the first element among the positions while maintaining electrical connection between the electrical connector and at least the first light source.

26. A light fixture comprising the lighting device recited in claim 1 and a second electrical connector that is configured to engage the first electrical connector.

27. A light fixture as recited in claim 26, wherein the second electrical connector is configured to engage the first electrical connector electrically and mechanically.

28. A light fixture as recited in claim 26, wherein the light fixture further comprises a housing.

29. A light fixture as recited in claim 28, wherein the second electrical connector is secured to a first location on the housing.

30. A light fixture as recited in claim 29, wherein the second electrical connector is removable from the first location on the housing and securable to at least a second location on the housing, the second location spaced from the first location.

31. A light fixture comprising a lighting device as recited in claim 10 and a second electrical connector that is configured to engage the first electrical connector.

32. A light fixture as recited in claim 31, wherein the second electrical connector is configured to engage the first electrical connector electrically and mechanically.

33. A light fixture as recited in claim 31, wherein the light fixture further comprises a housing.

34. A light fixture as recited in claim 33, wherein the second electrical connector is secured to a first location on the housing.

35. A light fixture as recited in claim 34, wherein the second electrical connector is removable from the first location on the housing and securable to at least a second location on the housing, the second location spaced from the first location.

36. A method of installing a lighting device, the method comprising:

connecting a first electrical connector of a first element to a second electrical connector; and positioning a second element that comprises at least one light source relative to the first element by moving a first structure of a position-retaining element relative to a second structure of the position-retaining element, the first structure attached to the first element and comprising at least two spring-loaded arms, the second structure attached to the second element, the second structure in frictional contact with the first structure and movable relative to the first structure, the position-retaining element thereby holding the second element in any of at least two positions relative to the first element, the second element movable relative to the first element among the positions.

37. A method as recited in claim 36, wherein the method further comprises removing an electrical connector of a light device from the second electrical connector before connecting the first electrical connector to the second electrical connector.

38. A method as recited in claim 36, wherein the connecting a first electrical connector of a first element to a second electrical connector comprises connecting the first electrical connector of the first element to the second electrical connector mechanically and electrically.

39. A lighting device as recited in claim 1, wherein the first structure is slidable relative to the second structure.

40. A lighting device as recited in claim 1, wherein at least a portion of the electrical connection between the first electrical connector and the first light source is visibly exposed, said portion not comprising any part of the first electrical connector.

41. A lighting device as recited in claim 1, wherein the first structure is non-integral with the second structure.

42. A lighting device, comprising:

a first element that comprises a first electrical connector, a second element that comprises at least a first light source, and a position-retaining element that is configured to hold the second element in any of at least two positions relative to the first element, and that is configured to connect to the first element and to the second element, the position-retaining element biasing the second element toward the first element, the position-retaining element comprising an axial spring, the first electrical connector electrically connected to at least the first light source, the second element movable relative to the first element among the positions while maintaining electrical connection between the first electrical connector and at least the first light source.

43. A lighting device as recited in claim 1, wherein the first structure and the second structure are detachable from each other and reattachable to each other.

44. A lighting device as recited in claim 1, wherein each spring-loaded arm comprises a hook.

45. A lighting device as recited in claim 44, wherein a spring is between at least a first of the pair of spring-loaded arms and at least a second of the at least two spring-loaded arms, and the first and second spring-loaded arms are spring-biased apart from each other at an angle pivoting from the spring.

46. A lighting device, comprising:

a first element that comprises a first electrical connector, a second element that comprises at least a first light source, and a position-retaining element that is configured to hold the second element in any of at least two positions relative to the first element, and that is configured to connect to the first element and to the second element, the position-retaining element biasing the second element toward the first element, the position-retaining element comprising at least a first retracting reel, the first electrical connector electrically connected to at least the first light source, the second element movable relative to the first element among the positions while maintaining electrical connection between the first electrical connector and at least the first light source.

* * * * *